US007358443B2

(12) United States Patent
Shatkin et al.

(10) Patent No.: US 7,358,443 B2
(45) Date of Patent: Apr. 15, 2008

(54) BRAIDED CORD WITH CONDUCTIVE FOIL

(75) Inventors: Louis J. Shatkin, Warwick, RI (US); Chepur P. Rao, Providence, RI (US); Victor V. Aromin, W. Warwick, RI (US)

(73) Assignee: Tower Manufacturing, Providence, RI (US)

( * ) Notice: Subject to any disclaimer, the term of this patent is extended or adjusted under 35 U.S.C. 154(b) by 0 days.

(21) Appl. No.: 11/507,422

(22) Filed: Aug. 21, 2006

(65) Prior Publication Data

US 2007/0062721 A1 Mar. 22, 2007

(51) Int. Cl.
*H01B 7/18* (2006.01)

(52) U.S. Cl. ..... 174/102 R; 174/103

(58) Field of Classification Search ..... 174/36, 174/110 R, 113 R, 117 R, 117 F, 117 FF
See application file for complete search history.

(56) References Cited

U.S. PATENT DOCUMENTS 5,245,161 A * 9/1993 Okamoto ..... 219/549
6,243,018 B1 * 6/2001 Saito et al. ..... 340/650
6,288,372 B1 * 9/2001 Sandberg et al. ..... 219/544
6,362,432 B1 * 3/2002 LaPidus et al. ..... 174/113 R
6,958,463 B1 * 10/2005 Kochman et al. ..... 219/544
6,967,288 B2 * 11/2005 Ohsawa et al. ..... 174/104
2003/0132022 A1 * 7/2003 Williams et al. ..... 174/113 R

FOREIGN PATENT DOCUMENTS

CA 2 503 933 A * 10/2005

* cited by examiner

*Primary Examiner*—William H. Mayo, III
(74) *Attorney, Agent, or Firm*—Grimes & Battersby LLP; James F. McLaughlin

(57) ABSTRACT

A braided cord having a conductive foil made of aluminum or copper or similar good electrically conductive materials. The foil is wrapped around the line (hot) and neutral wires of a cord. Over the foil is the braid made of copper strands.

9 Claims, 2 Drawing Sheets

BRAIDED CORD WITH CONDUCTIVE FOIL

BACKGROUND OF THE INVENTION

1. Field of the Invention

The present invention relates generally to shielded cords, and more particularly, to braided cords that may be used in leakage current detection and interruption (LCDI) applications, and even more particularly to a braided cord utilizing a conductive foil made of aluminum or copper or any electrically conductive material so as to reduced the coverage of copper braiding typically required in such cords.

2. Description of the Prior Art

Conventional shielded cords for existing leakage current detection and interruption (LCID) application requires 85% coverage of copper strands at a minimum. The rising cost of copper and the need for more economical cords used in LCDIs requires a more economical construction utilizing a conductive coil and reduced copper braiding.

Previous conventional cords do not have the conductive foil and require much higher coverage for the copper braiding. UL requires 85% minimum coverage of copper braiding, which is very expensive due to the increase in copper costs. In the past 18 months, the price of copper doubled, making the cost of conventional braided cord prohibitive in the LCDI application.

Disclosed in the prior art are a number of different cable systems having different core and exterior compositions. For example, U.S. Patent Application No. 20050016755 which was filed in the name of Martinez, et al. on Jan. 27, 2005 for "Dry, water-resistant coaxial cable and manufacturing method of the same" discloses dry coaxial cable resistant to water penetration, made of a core conductor, a dielectric element based on three layers of polymers, and an external conductor and an extruded cover, characterized because it has swellable protecting elements against water penetration placed between the external conductor and the braided cord.

Another example of a cable assembly is taught in U.S. Pat. No. 5,767,442, which issued to Eisenberg, et al. on Jun. 16, 1998 for "Non-skew cable assembly and method of making the same," which discloses a cable assembly having a plurality of insulated wires that are arranged in groups of one or more wires with adjacent pairs of the groups being interconnected at any given longitudinal location over the length of the cable.

Making such cable water-proof or resistant has also been known in the art. For example, U.S. Pat. No. 6,455,769, which issued to Belli, et al. on Sep. 24, 2002 for "Electrical cable having a semiconductive water-blocking expanded layer" discloses electrical cable having a metal shield and a semiconductive water-blocking expanded layer. Another such example is shown in U.S. Pat. No. 3,589,121, which issued to Mulvey on Jun. 29, 1971 for "Method of Making Fluid-Blocked Stranded Conductor," which discloses an insulated stranded conductor manufactured by first coating a wire filament or strand, and then forming a stranded conductor with the coated filament as the center strand, then applying an outer insulation over the resulting stranded conductor under sufficient pressure to at least partially fill the interstitial spaces between the strands.

Disclosed in U.S. Pat. No. 6,369,328, which issued to Munakata on Apr. 9, 2002 for "Heat dissipating device for transmission line, transmission line with heat dissipating device, and method for fitting heat dissipating device to transmission line" is a braided heat conducting wire heat dissipating belt wound around an outer circumference of an already strung aerial line or jumper so as to increase the heat dissipation effect of the surface of the aerial line so as to enable the capacity of a permissible power supply of the already existing aerial line to be increased.

A number of prior art references are directed to fence wire construction. For example, U.S. Pat. No. 5,036,166, which issued to Monopoli on Jul. 30, 1991 for "Electric fence line" discloses an electric fence line formed of strands of a high strength and high visibility electrically insulative material, which have been woven, twisted, or braided, together with at least one highly electrically conductive low electrical resistance metal strand, such as copper wire, and at least one high-strength metal strand of higher electrical resistance, such as stainless steel. Similarly, U.S. Pat. No. 4,905,969, which issued to Kurschner, et al. on Mar. 6, 1990 for "Electric fence wire construction" discloses an electric fence wire construction is made by plying or weaving coated supporting members, preferably fiberglass coated with polyvinyl chloride, with conducting members, preferably aluminum.

Yet another example is discussed in U.S. Pat. No. 3,067,569, which issued to Kelley Jr. on Dec. 11, 1962 for "Electrical Conductors and Methods of Manufacture Thereof."

Similar processes of manufacture are also used in other applications, as is disclosed in U.S. Pat. No. 6,601,377, which issued to Tsukamoto on Aug. 5, 2003 for "Gland packing materials made from expansive graphite, gland packing made from expansive graphite made from the materials, and a producing method of gland packing made from expansive graphite," and which teaches the use of gland packing materials made from expansive graphite, gland packing made from expansive graphite made from the materials, and a producing method of gland packing made from expansive graphite.

As shall be appreciated, the prior art fails to specifically address either the problem or the solution arrived upon by applicant.

SUMMARY OF THE INVENTION

Against the foregoing background, it is a primary object of the present invention to provide a braided cord having a foil core.

It is another object of the present invention to provide such a braided cord in which the core is composed of an electrically conductive material such as aluminum or copper.

It is but another object of the present invention to provide such a braided cord in which the foil may have a plastic backing, such as Mylar.

It is yet another object of the present invention to provide such a braided cord that is less expensive to produce and manufacture because a material that is less expensive than copper may be used in the manufacture.

It is another object of the present invention to provide such a braided cord that does not require the 85% coverage of copper braiding typically required in LCDI applications.

It is still another object of the present invention to provide such a braided cord that may be used on room air conditioner power supply cords.

It is but another object of the present invention to provide such a braided cord that would satisfy NEC and UL standards.

It is yet another object of the present invention to provide such a braided cord that can have as little as 5% to 10% coverage of copper braiding.

It is but another object of the present invention to provide such a braided cord that can also have as much as 85% or more coverage of copper braiding.

To the accomplishments of the foregoing objects and advantages, the present invention, in brief summary, comprises a braided cord utilizing a conductive foil made of aluminum or copper or similar good electrically conductive materials. The foil is wrapped around the line (hot) and neutral wires of a cord. Over the foil is the braid made of copper strands. Due to the conductive foil underneath the braid of copper strands, the amount of braid coverage can be considerably reduced, thus making the cord used in LCDI applications considerably less expensive. The LCDI's are typically used on room air conditional power supply cords as required by the NEC and UL standards. LCDI's are used in many electrical applications related to safety including but not limited to room air conditioners.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

BRIEF DESCRIPTION OF THE PREFERRED EMBODIMENTS

Figure 1:
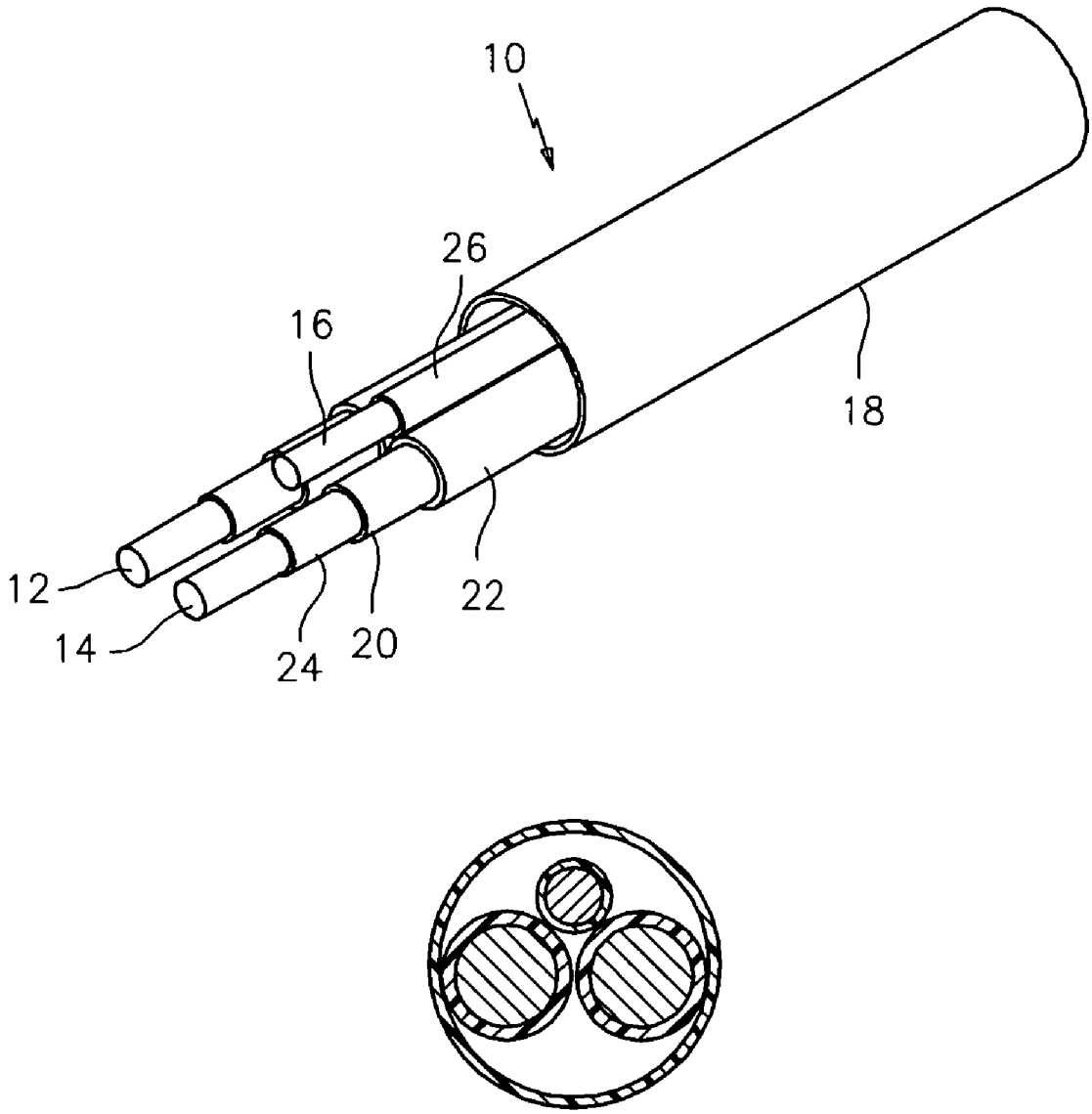
FIG. 1 is a perspective illustration of one possible configuration of the braided cord of the present invention.
Figure 2:
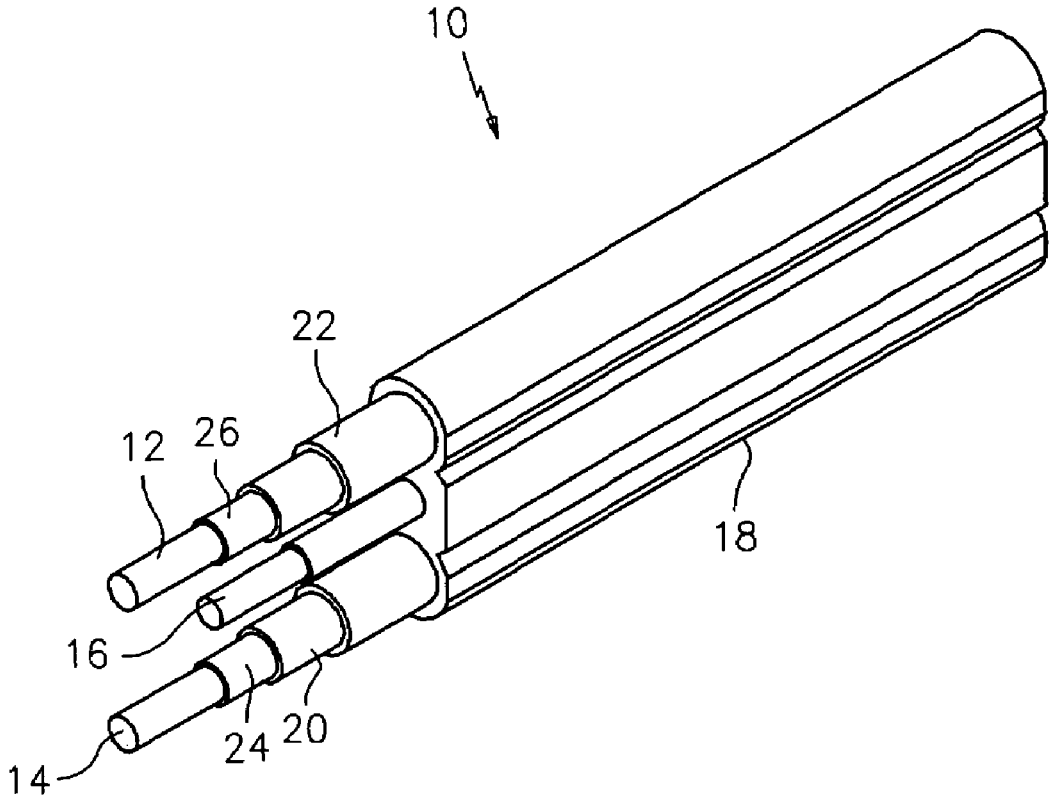
FIG. 2 is a perspective illustration of another possible configuration of the braided cord of the present invention.
Figure 2:
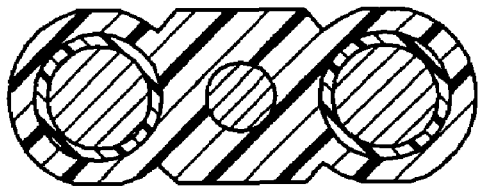

Referring to the drawings and, in particular, to FIGS. 1 and 2 thereof, the braided cord of the present invention is provided and is referred to generally by reference numeral 10. The braided cord 10 comprises a hot line 12, a neutral line 14 and a ground wire 16. All three wires 12, 14, 16 are housed within an outer jacket, which is typically an insulated, non-conducting material. The three wires 12, 14, 16 are typically composed of a copper conductor. A conductive foil 20 made of aluminum or copper or similar good electrically conductive material is wrapped around the hot line 12 and neutral wires 14 of the cord 10. Wrapped around the foil 20 is a braid 22 composed of copper strands. Due to the conductive foil 20 underneath the braid of copper strands 22, the total amount of braid 22 coverage can be considerably reduced, thus making the cord considerably less expensive to manufacture. A backing material 24 or insulation may also provided underneath the conductive foil 20. Insulation 26 is also provided around the ground wire 16 as well as the hot line 12 and neutral line 14.

Having thus described the invention with particular reference to the preferred forms thereof, it will be obvious that various changes and modifications can be made therein without departing from the spirit and scope of the present invention as defined by the appended claims. For example, different foil 20 materials may be used, such as aluminum, copper or such similar good electrically conductive materials. Different thicknesses of foil 20 may be used, as may different plastic backing materials 24 of the foil, such as polyester. Alternatively, different thicknesses of backing 24 may also be used. The amount of copper coverage may also vary. An alternate construction would involve the foil 20 and copper braid 22 coverage would be around the three conductors 12, 14, 16 and the outer insulation jacket 26 is molded over them.

We claim:

1. A braided cord having a hot line, a neutral line and a ground wire surrounded by an outer jacket, wherein the hot line and neutral line each comprise a copper conductor wrapped with insulation, and further wherein a conductive foil layer and a copper braid composed of copper strands is individually wrapped around the insulation of each of said hot line and said neutral line.

2. The braided cord of claim 1, wherein said conductive foil is composed of a good electrically conductive material.

3. The braided cord of claim 2, wherein said conductive foil is composed of aluminum.

4. The braided cord of claim 1, wherein said copper braid provides coverage, and wherein said coverage may be as low as 5% due to the presence of said foil layer.

5. The braided cord of claim 1, wherein said cord is used for leakage current detection and interruption applications.

6. A braided cord having a hot line, a neutral line and a ground wire surrounded by an outer jacket, wherein the hot line and neutral line each comprise a copper conductor wrapped with insulation, and further wherein a conductive foil layer composed of a good electrically conductive material and a copper braid composed of copper strands is individually wrapped around the insulation of each of said hot line and said neutral line, wherein said copper braid provides coverage, and wherein said coverage may be as low as 5% due to the presence of said foil layer.

7. The braided cord of claim 6, wherein said conductive foil is composed of aluminum.

8. The braided cord of claim 6, wherein said cord is used for leakage current detection and interruption applications.

9. A method for detecting leakage current and interruption in an electrical cord having a hot line, a neutral line and a ground wire surrounded by a shield, said method comprising the steps of:

providing a braided cord having said hot line, said neutral line and said ground wire surrounded by an outer jacket, wherein the hot line and neutral line each comprise a copper conductor wrapped with insulation, and further wherein a conductive foil layer and a copper braid composed of copper strands is individually wrapped around the insulation of each of said hot line and said neutral line;

separately detecting leakage current from said hot line to said shield and from said neutral line to said shield; and disabling said electrical cord in the event of said detected leakage current.

* * * * *